US009799158B2

(12) United States Patent
String

(10) Patent No.: US 9,799,158 B2
(45) Date of Patent: Oct. 24, 2017

(54) COIN PROCESSING MACHINE

(71) Applicant: GCCM, LLC, Harrisburg, PA (US)

(72) Inventor: Gregory F. String, Mechanicsburg, PA (US)

(73) Assignee: GCCM, LLC, Mechanicsburg, PA (US)

( * ) Notice: Subject to any disclaimer, the term of this patent is extended or adjusted under 35 U.S.C. 154(b) by 0 days.

(21) Appl. No.: 14/803,660

(22) Filed: Jul. 20, 2015

(65) Prior Publication Data

US 2015/0325071 A1 Nov. 12, 2015

Related U.S. Application Data

(62) Division of application No. 14/666,399, filed on Mar. 24, 2015, now Pat. No. 9,177,431.

(60) Provisional application No. 61/981,449, filed on Apr. 18, 2014.

(51) Int. Cl.

| | |
|---|---|
| ***G07D 3/00*** | (2006.01) |
| ***G07F 1/04*** | (2006.01) |
| ***G07D 3/12*** | (2006.01) |
| ***G07D 11/00*** | (2006.01) |
| ***G07D 3/02*** | (2006.01) |
| ***G07D 3/06*** | (2006.01) |
| ***G07F 9/02*** | (2006.01) |

(52) U.S. Cl.

CPC ..... *G07F 1/04* (2013.01); *G07D 3/00* (2013.01); *G07D 3/02* (2013.01); *G07D 3/06* (2013.01); *G07D 3/128* (2013.01); *G07D 11/0039* (2013.01); *G07F 1/046* (2013.01); *G07F 9/02* (2013.01)

(58) Field of Classification Search

CPC .. G07D 3/14; G07D 3/02; G07D 3/06; G07D 3/128; G07D 9/00; G07D 9/008; G07D 7/128; G07D 3/123; G07D 3/12; G07D 1/00; G07D 1/02; G07D 1/04; G07D 1/08; G07D 3/00; G07D 3/16; G07D 9/002; G07D 9/004; G07D 9/006; G07D 9/06; G07D 9/065; G07D 13/00; G07D 2201/00; G07F 11/16; G07F 11/005; G07F 5/20; G07F 5/22; G07F 5/24; G07F 9/08; G07F 3/04

USPC ..... 193/DIG. 1; 453/3–15, 18–23, 29–43, 453/49, 51–54, 56, 57; 194/344–347, 194/350, 353

See application file for complete search history.

(56) References Cited

U.S. PATENT DOCUMENTS 4,648,819 A * 3/1987 Sakamaki ..... F04C 18/348 418/173
5,167,571 A * 12/1992 Waller ..... G07D 9/008 453/29

(Continued)

FOREIGN PATENT DOCUMENTS

JP 02000237739 A * 1/2002 ..... G07D 1/00

OTHER PUBLICATIONS

English translation of JP02002015349A.*

*Primary Examiner* — Jeffrey Shapiro
(74) *Attorney, Agent, or Firm* — Hooker & Habib, P.C.

(57) ABSTRACT

A coin processing machine includes a coin support plate having a coin support surface defining a coin path extending from an intake location to a coin removal station. Depressions formed in the coin path reduce the likelihood of coins, particularly wet coins, from adhering to and stopping along the coin path.

16 Claims, 5 Drawing Sheets

(56) References Cited

U.S. PATENT DOCUMENTS 5,316,521 A * 5/1994 Ayre, Jr. ..... A63D 1/04 473/115
5,370,575 A * 12/1994 Geib ..... G07D 3/02 453/10
5,472,381 A * 12/1995 Ayre, Jr. ..... A63D 1/04 473/115
5,842,916 A * 12/1998 Gerrity ..... B07B 1/24 453/57
5,988,348 A * 11/1999 Martin ..... G07D 3/06 194/317
6,168,001 B1 * 1/2001 Davis ..... G07D 3/14 194/200
6,174,230 B1 * 1/2001 Gerrity ..... B07B 1/24 453/57
6,196,371 B1 * 3/2001 Martin ..... G07D 3/06 194/317
6,863,168 B1 * 3/2005 Gerrity ..... B07B 1/24 194/347
7,243,774 B2 7/2007 String
7,883,401 B1 * 2/2011 String ..... G07D 3/06 453/10
8,475,242 B2 7/2013 String
2001/0006883 A1 * 7/2001 Abe ..... G07D 9/008 453/18
2004/0238320 A1 * 12/2004 Hino ..... G07D 3/00 194/302
2007/0000207 A1 * 1/2007 Bernhard ..... F16C 17/24 53/167
2008/0273825 A1 * 11/2008 Morales Espejel ..... F16C 17/02 384/549
2009/0127066 A1 * 5/2009 Kaneko ..... G07D 1/02 194/344
2009/0305620 A1 * 12/2009 Hino ..... G07D 3/06 453/5
2009/0325475 A1 * 12/2009 Hino ..... G07D 3/06 453/57
2010/0288222 A1 * 11/2010 Urabe ..... F16J 10/04 123/193.2
2011/0142384 A1 * 6/2011 Hofmann ..... C23C 30/005 384/42
2012/0276828 A1 * 11/2012 String ..... G07D 3/128 453/10
2013/0269834 A1 * 10/2013 Haschke ..... B65B 5/00 141/390
2014/0170377 A1 * 6/2014 Hsu ..... F02F 1/20 428/141
2016/0029820 A1 * 2/2016 Mack ..... B65G 11/023 186/49

* cited by examiner

COIN PROCESSING MACHINE

RELATED APPLICATION

This application claims priority from my U.S. patent application Ser. No. 14/666,399 "Coin Processing Machine" filed Mar. 24, 2015 that issued as U.S. Pat. No. 9,177,431, which in turn claimed priority from my Provisional Patent Application No. 61/981,449 "Coin Processing Machine" filed Apr. 18, 2014, which two priority applications are each incorporated by reference as if fully set forth herein.

FIELD OF THE DISCLOSURE

This disclosure relates to devices that sort or verify coins, and in particular, to devices that drive a singulated stream of coins along a coin path for sorting or verifying.

BACKGROUND OF THE DISCLOSURE

A conventional coin processing machine includes a stationary coin processing plate or rail that supports coins sliding on the plate or rail along a coin path defined on a coin support surface of the plate or rail. A coin slides along the coin path from an initial intake location to a coin removal station where the coin is removed from the support surface. The coin removal station may include, for non-limiting examples, a through-hole that drops coins off the support surface, a guide surface that forces or diverts the coin off the support surface, or a mechanical device that selectively obstructs the coin path and diverts or pushes a coin off the support surface. A coin processing machine may include one coin removal station at the end of the coin path or may include multiple coin removal stations spaced along the coin path. Each station of the multiple removal stations may be dedicated to removing a respective coin denomination off the support surface.

The coins may pass coin sensors, imaging devices, or the like along the coin path to validate and/or determine the diameter and denomination of the coins before reaching the one or more coin removal stations.

A non-limiting example of a known coin processing machine is disclosed in my U.S. Pat. No. 7,243,774, a portion of which is shown in FIG. 6. The coin processing machine includes a conventional processing plate or coin support plate 10, the plate 10 having a flat coin support surface 12. An outer wall 14 extends around a portion of the outer periphery of the support plate 10 and extends above the support plate surface 12. The coin path 16 extends on the support surface 12 adjacent the wall 14 from an upstream intake location represented by the arrow 17 downstream to a coin removal station 18 formed as a through-hole in the plate 10. The coin processing machine is used for coin counting and not coin sorting, and so the coin removal station 18 is the sole coin removal station and removes all the coins from the coin sorting plate.

A sensor set 20 is disposed on the coin path upstream from the coin removal station 18 and determines the size and denomination of coins moving past the sensor set. The radially outermost sensor 20A of the illustrated sensor set 20, for example, is just covered by the outer portion of a US dime moving on the coin path against the wall 14.

Coins are introduced on the coin support surface 12 at the intake location 17 and slide along the coin path 16 to the coin removal station 18. A rotating drive member located above the processing plate has circumferentially spaced, radially elongate, resilient fingers 22 that extend down and press the coins against the support surface 12, the fingers engaging and driving the coins on the coin path 16 (for clarity, only one finger 22 is shown in phantom lines in FIG. 6). The fingers 22 apply a drive torque or a drive force urging the coins along the coin path, but enable centrifugal force to urge the coins against the wall 14 to accurately position the coins on the coin path 16. This feature is conventional and so will not be described in greater detail.

When wet coins are fed onto the coin support surface 12, a wet coin occasionally becomes stationary on the coin support surface 12 and is unable to be driven by the drive member. It is theorized that moisture generates "suction" causing drag between the coin and the coin support surface 12. The drive member is unable to overcome the drag and the coin comes to a stop, creating a jam in the coin processing machine. The drive member continues attempting to move the stationary coin but cannot. The machine must be stopped to clear the coin jam.

The current series of US dime has a diameter of 17.91 mm and a thickness of 1.35 mm and is the thinnest and lightest US coin denomination. Because of this, a wet dime is by far the most likely coin to "stick" and become stationary on the coin support surface. Being the thinnest coin, the force applied to dimes by the drive member is lower than other coins. It is therefore more difficult for the drive member to apply force sufficient to overcome the drag applied to the dime by moisture.

It would be desirable to reduce the tendency of wet coins to stop on the processing plate. It would also be desirable to automatically stop the drive member when a coin jam occurs on the processing plate of the coin processing machine.

BRIEF SUMMARY OF THE DISCLOSURE

Disclosed is a coin processing machine that includes one or more features to reduce the likelihood of wet coins stopping and causing coin jams during coin processing.

A coin processing plate for a coin processing machine includes a modified coin processing plate that reduces the tendency of wet coins to stop on the processing plate. A number of closely spaced apart depressions are formed on the support surface of the coin processing plate. The size and spacing of the depressions are selected such that the smallest diameter coin intended to be used with the machine completely or partially overlays more than one depression. In this way the depressions do not apply forces to coins moving on the coin path that would affect the path of travel of the coins on the coin path.

The depressions may be formed in the coin path to the first or only coin removal station, or may also be formed in the coin path between adjacent pairs of coin removal stations. The size and spacing of the depressions may differ between adjacent pairs of coin removal stations to reflect the removal of coins at the upstream coin removal station.

The applicant has found that modifying the coin plate to include the described depressions greatly reduces the likelihood of a wet coin stopping on the coin support surface. It is theorized that reducing the surface area of the support surface in contact with the coin decreases the drag on the coin. Because dimes are the most likely US coin to cause jamming, providing depressions covering only the portion of the coin path that will be passed over by dimes was found to be essentially as effective in reducing coin jams as would providing depressions on the entire radial width of the coin path. Thus in an embodiment no depressions are provided along the coin path downstream from a dime removal station. However, in alternative embodiments the depressions are formed on a greater or lesser portion of the coin path as desired.

Other objects and features of the disclosure will become apparent as the description proceeds, especially when taken in conjunction with the accompanying drawing sheets illustrating one or more non-limiting embodiments.

DETAILED DESCRIPTION

Figure 1:
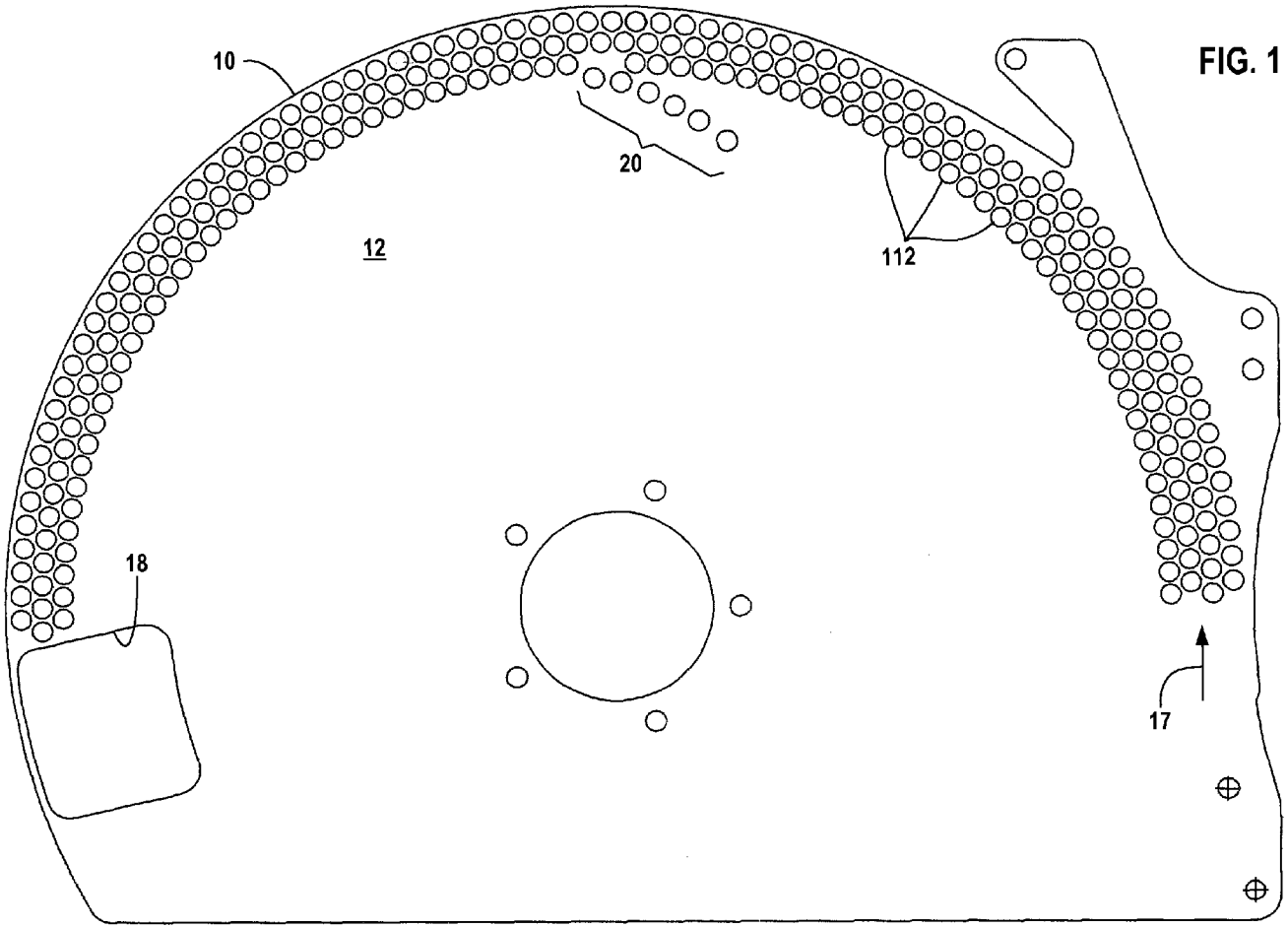
FIG. 1 is a top view of the coin support plate of a coin processing machine having a first type coin removal station and recesses on the coin path extending to the coin removal station.
Figure 6:
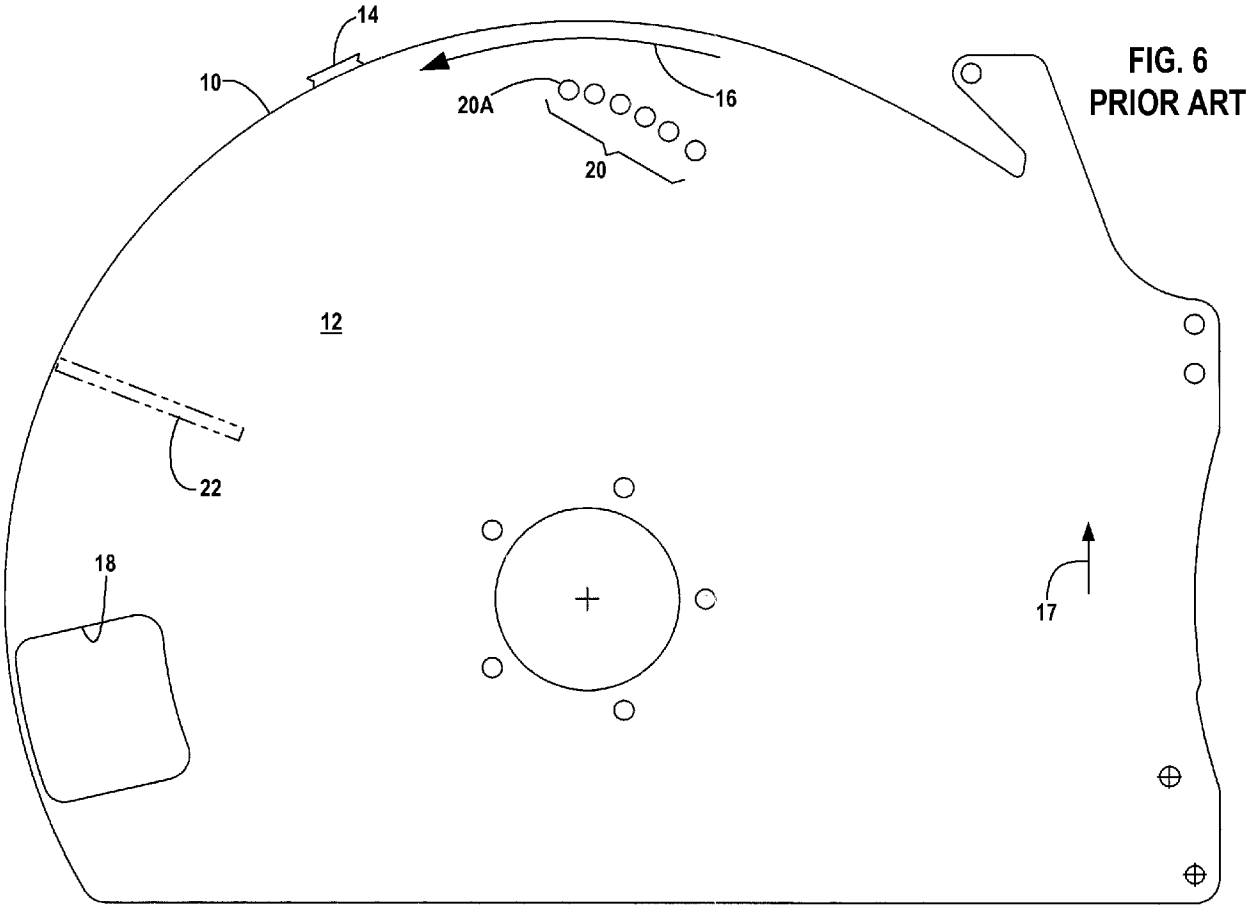
FIG. 6 PRIOR ART
FIG. 6 is a top view of the coin sorting plate of a conventional coin processing machine.

FIG. 1 illustrates a coin processing machine similar to the coin processing machine shown in FIG. 6 but modified in accordance with the present disclosure. Identical components are numbered with the same reference numbers. To simplify the drawing the wall 14 is not shown in FIG. 1.

The coin processing machine shown in FIG. 1 is designed to process US denomination coins, including the penny, nickel, dime, quarter, and dollar coins. The coin processing machine has a coin support plate 10 that includes a number of closely spaced apart depressions 112 formed in the coin support surface 12. The depressions 112 are formed in the radially outer portion of the coin path 16 adjacent the wall 14. Coins sliding on the coin support surface 12 along the coin path 16 from the intake location 17 to the coin removal station 18 pass over and are not received into the depressions 112. Thus the depressions 112 do not apply forces to the coins that would otherwise change the nominal path of travel of coins along the coin path.

In the illustrated embodiment the depressions 112 are disposed only in the portion of the coin path 16 covered by a US dime moving along the coin path against the peripheral wall 14.

Each illustrated depression 112 is about one-quarter inch in diameter, about 0.050 inches deep, and are spaced apart about 0.050 inches from adjacent depressions 112. The size and spacing of the depressions 112 are selected such that a current series US dime (a dime having a nominal diameter of 0.705 inches) could completely or partially overlay more than one depression 112. The size, shape, depth, number, and spacing of the depressions 112 vary in other embodiments based on the size of the coins being sorted, the length of the coin path, the radial width of the coin path to include the depressions, location of coin sensors, and other design considerations.

It has been found that modifying the coin plate 10 to include the depressions 112 greatly reduce the likelihood of a wet coin stopping on the coin support surface 12. It is theorized that reducing the surface area of the support plate in contact with the coin decreases the drag on the coin. Because dimes are most likely to cause jamming, providing depressions 112 covering only the portion of the coin support plate that will be moved over by dimes was found to be essentially as effective in reducing coin jams as would providing depressions 112 on the entire coin path. However, the depressions 112 could be formed on a greater or lesser portion of the coin path if desired.

In alternative embodiments, the depressions 112 are replaced or formed by narrow, radially spaced arcuate grooves formed on the support surface 12, the grooves in a possible embodiment being concentric with the wall 14 or otherwise parallel with the coin path 16. See FIG. 2. Other groove or depression geometries and spacings could be used to reduce the instantaneous surface area of the support plate in contact with a coin on the coin path.

Figure 3:
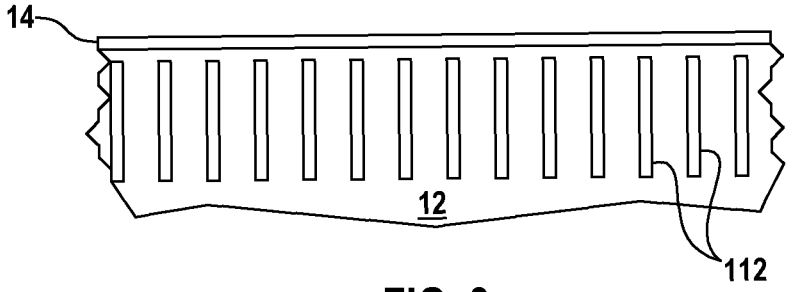

In yet other possible embodiments, the grooves or depressions 112 could be formed as circumferentially spaced, radially-extending grooves. See FIG. 3.

The distance between grooves or depressions 112 may be less than the width of the smallest diameter coin intended to be used with the coin processing machine. In other embodiments the distance between grooves or depressions 112 may be greater than the width of the smallest diameter coin intended to be processed by the coin processing machine—that is, the support surface 12 would support the entire coin for relatively short portions along the coin path 16. These full support portions are preferably too short for the drag on the wet coin to substantially slow sliding of the coin along the coin path.

Figure 2:
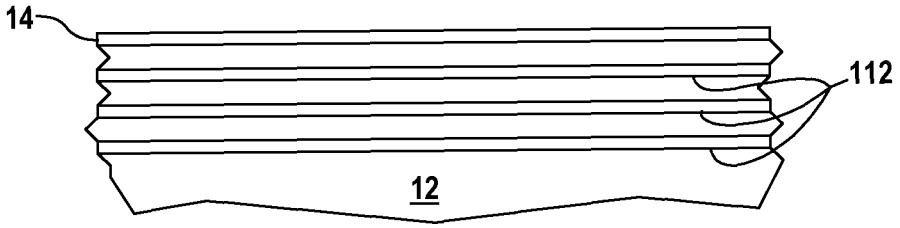
FIGS. 2 and 3 are top views of a portion of the coin support plate shown in FIG. 1 but with alternative recess geometries.
Figure 4:
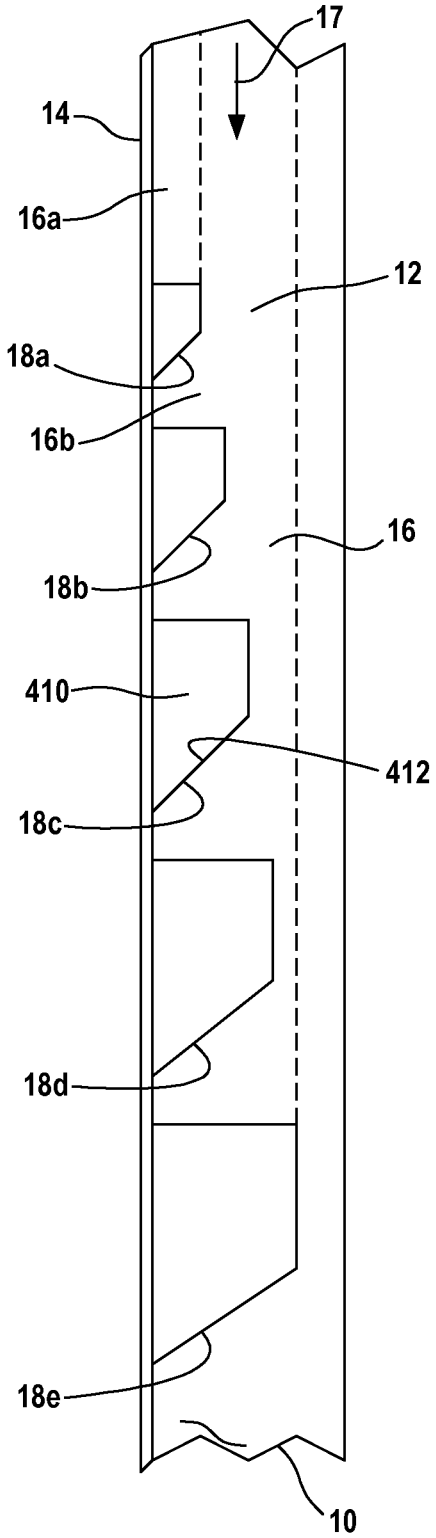
FIG. 4 is a top view of a coin support plate similar to the coin support plate shown in FIG. 1 but having a number of second-type coin removal stations.

FIG. 4 schematically illustrates a coin support plate 10 like that shown in FIG. 2 that defines a coin path 16 (to simplify the drawing the coin path 16 is shown as extending along a straight line rather than a curved or arcuate line). The support plate 10 includes a first coin removal station **18*a* on the coin path 16 that removes dimes from the coin support plate 10 and downstream coin removal stations 18*b*-18*e* that remove pennies, nickels, quarters, and dollars respectively from the coin support plate 10. Each coin removal station 18 includes a recess 410 that receives the coin associated with the coin removal station, the recess 410 being defined at least in part by an abutment wall 412 that guides a coin in the recess 410 off the coin support plate 10. Such coin removal stations 18*a*-18*e* are disclosed in my U.S. Pat. No. 8,475,242 that issued Jul. 2, 2013, which patent is incorporated by reference herein and so will not be described in greater detail. The abutment wall 412 applies a force to a coin on the coin path that falls into the recess 410 that changes the path of the coin and forces the coin to move off the coin path. Larger-diameter coins move over the recesses 410** associated with smaller-diameter coin removal stations without being received within them.

Thus the recesses 410 are sized to receive at least one denomination or diameter of coin of the coins for which the coin processing machine is intended to be used.

The portion **16*a* of the coin path 16 extending from the intake location 17 to the dime removal station 18*a* includes the depressions 112 as shown in FIG. 2 (to simplify the drawing, the depressions are not shown in FIG. 4). Unlike the recess 410 at the dime removal station 18*a*, the depressions 112 as previously described are sized to not receive dimes within them and so do not affect the path of dimes moving along the coin path over the depressions 112**.

The portion **16*b* of the coin path 16 extending downstream from the dime removal station 18*a* does not include any depressions 112 in the support surface 10** between adjacent coin removal stations because dimes do not travel on that portion of the coin path.

Figure 5:
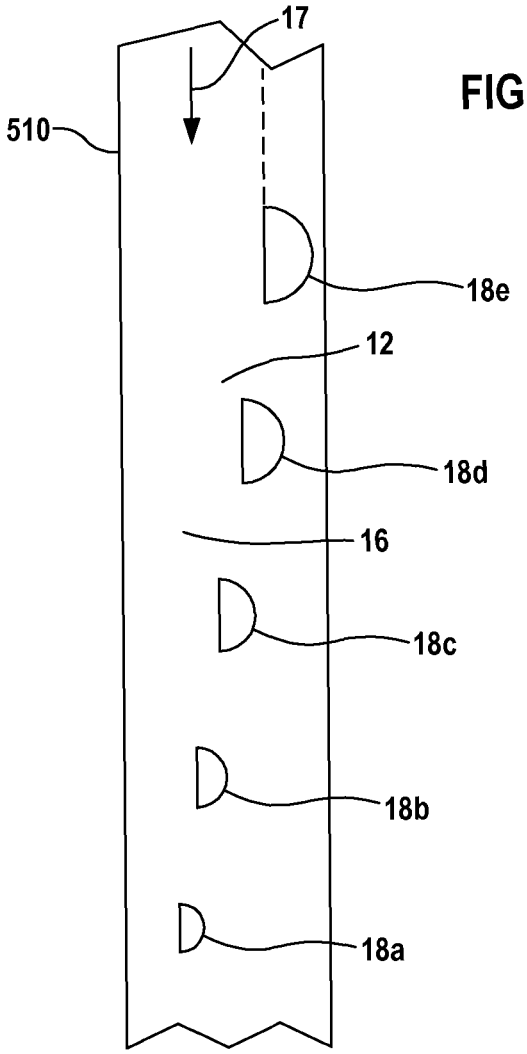
FIG. 5 is a top view of a coin rail having a number of third-type coin removal stations and recesses on the coin path extending to the coin removal stations.

In other embodiments of the coin processing plate 10 shown in FIG. 5, depressions 112 are formed along the entire coin path 16 from the intake location 17 to the most downstream coin removal station 18, or are located between some, but not necessarily all, adjacent pairs of coin removal stations 18. The depressions 112 may be located in the portion of the coin path covered by the minimum-diameter coin traveling along that portion of the coin path, could be located in the portion of the coin path covered by the maximum diameter coin traveling along that portion of the coin path, or may be located in the portion of the coin path covered by an intermediate diameter coin traveling along that portion of the coin path.

FIG. 5 schematically illustrates a coin rail 510 having a coin support surface 12 that defines a linear coin path 16 extending from an intake location 17. The coin path 16 extends along the left side of the coin rail 510 as viewed in FIG. 5. Spaced along the coin path 16 are coin removal stations 18*a*, 18*b*, 18*c*, 18*d*, 18*e*. Each coin removal station 18 is a device that is selectively actuated to rotate and present an abutment surface extending into the coin path to remove a coin passing the coin station from the coin rail 510. Selection, timing, and actuation of each coin removal station 18 to remove a coin from the coin rail is conventional and so will not be described in further detail.

Each coin removal station 18 is associated with a respective denomination of coin. In this embodiment the dime removal station 18*a* is the most downstream coin removal station. There are depressions (not shown) like the depressions 112 formed in the coin support surface 12 like those described previously above along the coin path 16 from the intake location 17 to the dime removal station 18*e* to reduce the risk of wet dimes stopping along the coin path 16.

The above embodiments are illustrated in part by a coin processing machine having drive fingers attached to the drive members to drive the coins on the coin support plate. Other ways of driving coins along a coin path are known and can be adapted for use with the drag reduction features described above.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art and fall within the purview of the following claims.

What is claimed is:

1. A coin processing machine that reduces the likelihood of coin jams, comprising:

a first coin removal station;

a coin support plate comprising a coin support surface on an upper side of the coin support plate, the coin support surface defining a coin path on the coin support surface, the coin path extending from an intake location to the coin removal station, the intake location spaced from the coin removal station along the coin path;

a drive member spaced from the coin support surface, the drive member and coin support surface being movable with respect to one another whereby relative movement between the drive member and coin support surface drives a coin on the coin path along the coin path when such coin is present on the coin path; and a plurality of empty depressions formed in the coin support surface, the depressions spaced apart from one another and located in the coin path between the intake location and the first coin removal station wherein coins sliding along the coin path on the coin from the intake location to the first coin removal station pass over some or all of the depressions without falling into the depressions, each depression comprising an open end at the coin support surface and extending into the coin support plate from the open end to a closed end.

2. The coin processing machine of claim 1 wherein the plurality of depressions comprises a plurality of concave surfaces spaced apart from one another.

3. The coin processing machine of claim 2 wherein each depression of the plurality of depressions has a diameter at the coin support surface of about one-quarter inch.

4. The coin processing machine of claim 2 wherein the coin path has a longitudinal direction extending from the intake location to the coin removal station and a width direction transverse to the longitudinal direction, the plurality of depressions spaced apart from one another along the longitudinal dimension and along the width dimension of the coin path.

5. The coin processing machine of claim 1 wherein the coin path has a longitudinal direction extending from the intake location to the coin removal station and a width direction transverse to the longitudinal direction, and the plurality of depressions comprise a plurality of elongate grooves extending in the longitudinal direction of the coin path, the grooves spaced apart from one another in the width direction of the coin path.

6. The coin processing machine of claim 1 wherein the coin path has a longitudinal direction extending from the intake location to the coin removal station and a width direction transverse to the longitudinal direction, and the plurality of depressions comprise a plurality of grooves extending in the transverse direction of the coin path, the grooves spaced apart from one another in the longitudinal direction of the coin path.

7. The coin processing machine of claim 1 wherein the coin processing machine is configured and disposed to process a first diameter coin denomination and a second diameter coin denomination, the second diameter being greater than the first diameter, and a first diameter coin slides on a first portion of the coin path when sliding from the intake location to the first coin removal station, wherein the depressions are located only in the first portion of the coin path.

8. The coin processing machine of claim 1 wherein the coin path extends in a downstream direction from the intake location, the coin processing machine comprises one or more additional coin removal stations spaced along the coin path, the coin path extends from the first coin removal station to the one or more additional coin removal stations, and the depressions are located only in the portion of the coin path extending from the intake location to the first coin removal station.

9. The coin processing machine of claim 1 wherein the coin path extends in a downstream direction from the intake location, and the coin processing machine comprises one or more additional coin removal stations spaced upstream along the coin path from the first coin removal station.

10. The coin processing machine of claim 1 wherein the first coin removal station comprises a through-hole opening from the coin support surface and through the coin support plate.

11. The coin processing machine of claim 1 wherein the first coin removal station comprises an abutment surface disposed generally perpendicular to the coin support surface.

12. The coin processing machine of claim 1 wherein the first coin removal station comprises a device actuatable to selectively block the coin path.

13. The coin processing machine of claim 1 wherein the coin processing machine is of the type capable of processing a smallest diameter coin having a diameter of 0.705 inches or greater, each depression having a width dimension at the coin support surface along the coin path of less than 0.705 inches.

14. The coin processing machine of claim 13 wherein the width dimension of each depression is less than 0.3525 inches.

15. The coin processing machine of claim 14 wherein the width dimension of each depression is not greater than 0.25 inches.

16. The coin processing machine of claim 1 wherein each depression has a width dimension at the coin support surface extending along the coin path of not greater than 0.25 inches.

* * * * *